US006618993B2

(12) United States Patent
Burke

(10) Patent No.: US 6,618,993 B2
(45) Date of Patent: Sep. 16, 2003

(54) RAILROAD GRADE CROSSING ASSEMBLY

(76) Inventor: Thomas J. Burke, 5 Matheson Rd., Whitehouse Station, NJ (US) 08889

( * ) Notice: Subject to any disclaimer, the term of this patent is extended or adjusted under 35 U.S.C. 154(b) by 0 days.

(21) Appl. No.: 09/811,998

(22) Filed: Mar. 19, 2001

(65) Prior Publication Data

US 2002/0129552 A1 Sep. 19, 2002

(51) Int. Cl.[7] ..... E01F 13/00
(52) U.S. Cl. ..... 49/49
(58) Field of Search ..... 49/33, 26, 28, 49/49; 246/125, 261, 272

(56) References Cited

U.S. PATENT DOCUMENTS

| | | | | | |
|---|---|---|---|---|---|
| 4,658,543 | A | * | 4/1987 | Carr | 49/139 |
| 4,666,108 | A | * | 5/1987 | Fox | 246/125 |
| 4,897,960 | A | * | 2/1990 | Barvinek et al. | 49/49 |
| 5,299,386 | A | * | 4/1994 | Naegelli et al. | 49/28 |
| 5,671,563 | A | * | 9/1997 | Marcum | 49/49 |
| 6,119,399 | A | * | 9/2000 | McCain et al. | 49/340 |
| 6,189,839 | B1 | * | 2/2001 | Lemieux | 246/293 |
| 6,212,825 | B1 | * | 4/2001 | Hopkins | 49/49 |

* cited by examiner

*Primary Examiner*—Jerry Redman
(74) *Attorney, Agent, or Firm*—Frommer Lawrence & Haug LLP; Matthew K. Ryan

(57) ABSTRACT

A railroad grade crossing assembly for blocking vehicle access across a railroad crossing including a gate assembly connectable to a stanchion and light assembly. This gate assembly is movable between a generally upright position to permit vehicle access across a railroad crossing and a generally horizontal position for blocking vehicle access across the railroad crossing. The gate assembly further includes a telescopic arm assembly for completely closing vehicle access to the railroad crossing. In another embodiment of the invention, the railroad grade crossing assembly includes a gate movable between a generally horizontal retracted position to permit vehicle access across a railroad crossing and a generally extended horizontal position for blocking vehicle access across a railroad crossing, the gate includes a telescopic arm for completely closing the railroad crossing, a first and second stanchions. The railroad grade crossing assembly also includes a battery to power the gate and a solar panel to recharge the battery. A low battery indicator may also be includes to indicate that said battery has a low voltage. A listening device is provided to detect the sound of an oncoming train and activate the gate, and a sensor is provided to sense when a train has passed and thereby cause the gate to retract.

47 Claims, 5 Drawing Sheets

RAILROAD GRADE CROSSING ASSEMBLY

FIELD OF THE INVENTION

The present invention relates to an improved railroad grade crossing assembly, and more particularly, to a railroad grade crossing assembly which is extendable to fully close the road or street leading to the track.

BACKGROUND OF THE INVENTION

Railroad grade crossing assemblies that are currently in use only close the road in the direction of traffic to within one foot of the center line. Therefore, the present railroad gates allow for a vehicle operator to make an S turn across the track thereby creating the potential for disaster. As a result, the railroads are currently under pressure to put in additional gates to completely close vehicle access to the tracks. It has therefore been found desirable to provide a railroad gate which allows a gate crossing to be completely closed prior to the arrival of a train.

A drawback in designing a railroad gate which completely closes the gate crossing is that is must comply with time requirement for closing a railroad crossing which are determined by federal, state and municipal governments. It is therefore further desirable to provide a railroad gate which not only completely closes the gate crossing but also complies with the time requirements for closing a railroad crossing which are determined by federal, state and municipal governments.

Currently, the installation of a single new railroad gate at a railroad crossing can cost upwards of $14,000, or $28,000 to $30,000 per crossing. With the over 56000 railroad crossings just in the United States, in order to attract the railroads to install any new railroad gate, that railroad gate must be relatively inexpensive. As a result, in order to minimize costs, it has been found desirable to provide a gate assembly which completely closes vehicle access to a railroad crossing which is adaptable to an existing railroad stanchion and light assembly. There are also railroad crossings which are in remote areas and have no power supply. As a result, in order to properly protect these crossings, it has been found desirable to provide a gate assembly which completely closes vehicle access to a railroad crossing which is self contained and provides its own power.

OBJECTS OF THE INVENTION

Therefore, it is an object of the invention to provide an improved railroad grade crossing assembly.

It is also an object of this invention to provide an improved railroad grade crossing assembly which completely closes the gate crossing prior to arrival of a train.

It is another object of this invention to provide a railroad grade crossing assembly which not only allows a gate crossing to be completely closed but also is adaptable to an existing stanchion and light assembly.

It is a further object of the present invention to provide a railroad grade crossing assembly which completely closes the gate crossing and complies with the time requirements for closing a railroad crossing which are mandated by federal, state and municipal governments.

It is yet another object of the present invention to provide a relatively inexpensive railroad grade crossing assembly capable of completely closing the gate crossing.

It is still another object of the invention to provide a railroad grade crossing assembly which can be readily attached to the arm of an existing railroad grade crossing system.

It is a further object of the invention to provide a self contained railroad grade crossing assembly which provides its own power.

Various other objects, advantages and features of the present invention will become readily apparent from the ensuing detailed description and the novel features will be particularly pointed out in the appended claims.

SUMMARY OF THE INVENTION

This invention relates to a railroad grade crossing assembly which restricts vehicles from crossing a railroad crossing prior to the arrival of a train. In contrast to current railroad grade crossing assemblies, the design of the railroad gate completely closes the gate crossing to vehicle access prior to arrival of a train.

The railroad grade crossing assembly of the present invention can be adapted to existing railroad stanchion, arm and/or light assemblies which previously included gate assemblies which only partially closed the railroad crossing. The railroad grade crossing assembly of the present invention includes an improved gate assembly adaptable to the existing stanchion, arm and/or light assembly. This gate assembly is comprised of a two piece telescopic arm (formed of first and second arm members) assembly and a gravity actuated support leg. Upon initial signal or sensing of a train approaching, the arm assembly falls to a generally horizontal position with the gravity operated support leg falling to a generally vertical position impinging upon the ground surface to support the arm Thereafter, but well prior to the train arriving at the crossing, the second arm member of the gate assembly extends outwardly from the first arm member to completely close the railroad crossing.

In another embodiment of the present invention the railroad grade crossing assembly includes a gate means movable between a generally horizontal retracted position to permit vehicle access across a railroad crossing and a generally extended horizontal position for blocking vehicle access across a railroad crossing, the gate means includes a telescopic arm for completely closing the railroad crossing, a first and second stanchions. The telescopic arm is extendable and retractable from the gate means wherein upon a pre-set interval prior to a train arriving at a railroad crossing, the gate means extends from its said generally retracted position to a generally extended position extending from said first stanchion to said second stanchion, to completely close the railroad crossing. The railroad grade crossing assembly also includes a battery to power the gate means and a solar panel to recharge the battery. A low battery indicator may also be includes to indicate that said battery has a low voltage. A listening device is provided to detect the sound of an oncoming train and activate the gate means, and a sensor is provided to sense when a train has passed and thereby cause the gate means to retract.

BRIEF DESCRIPTION OF THE DRAWINGS

The following detailed description given by way of example, but not intended to limit the invention solely to the specific embodiments described, may best be understood in conjunction with the accompanying drawings in which.

DETAILED DESCRIPTION OF A PREFERRED EMBODIMENT OF THE INVENTION

Figure 1:
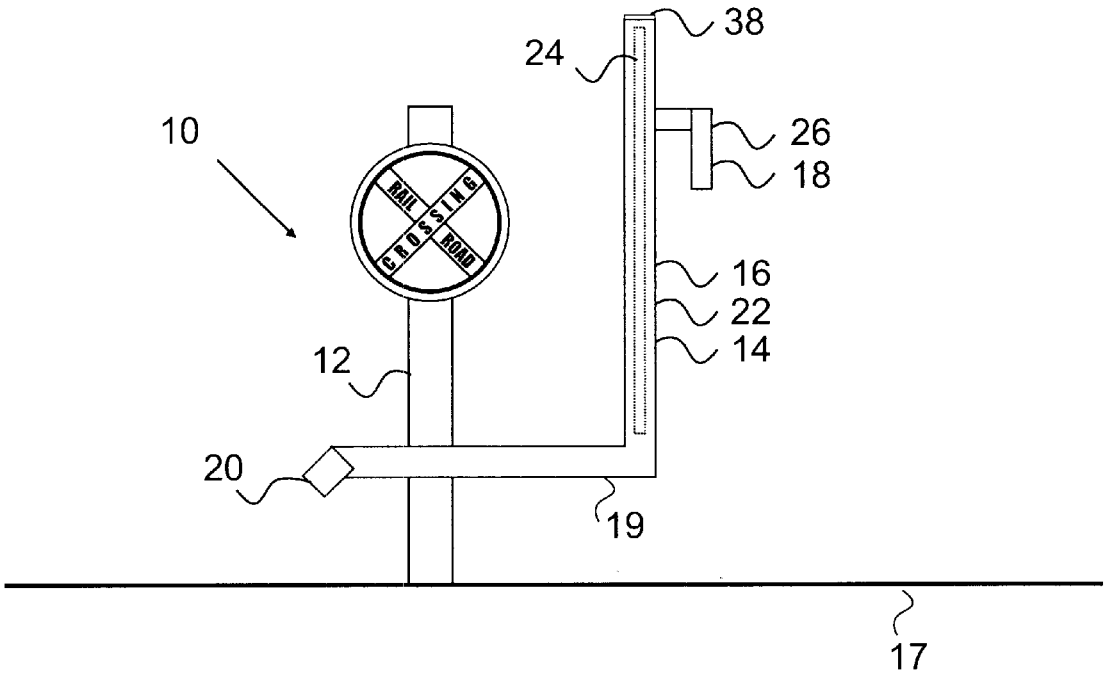
FIG. 1 is a front elevational view of a preferred embodiment of a railroad grade crossing assembly in accordance with the present invention in with the arm assembly in its generally upright position prior to arrival of a train.
Figure 2:
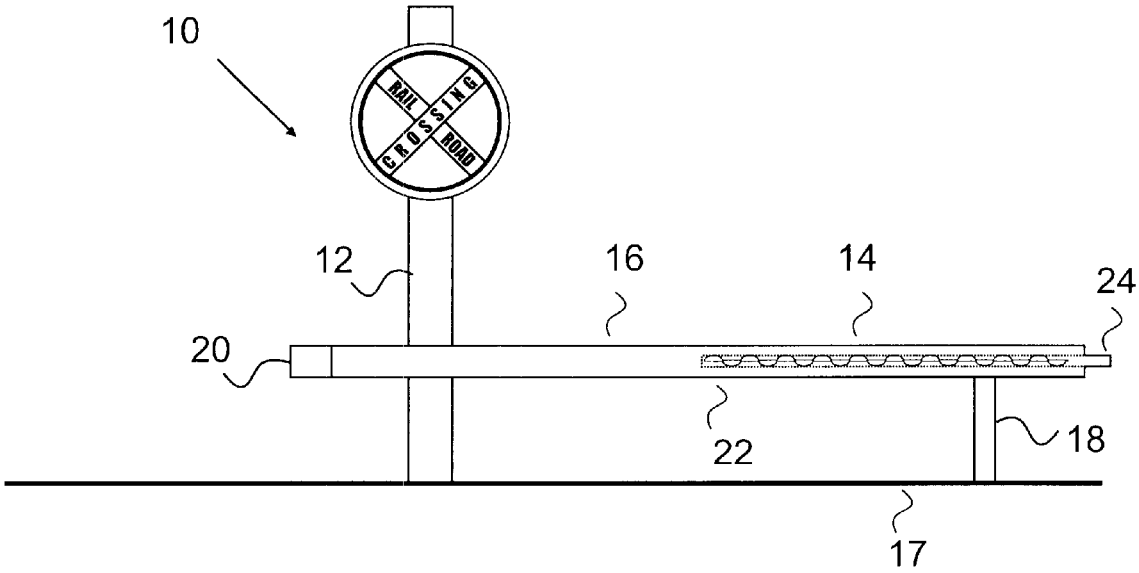
FIG. 2 is a front elevational view of the railroad grade crossing assembly assembly of FIG. 1 in a first train approaching position whereupon the arm assembly thereof is moved into a first generally horizontal position and the support leg thereof falls into a generally upright position supporting the arm assembly.
Figure 3:
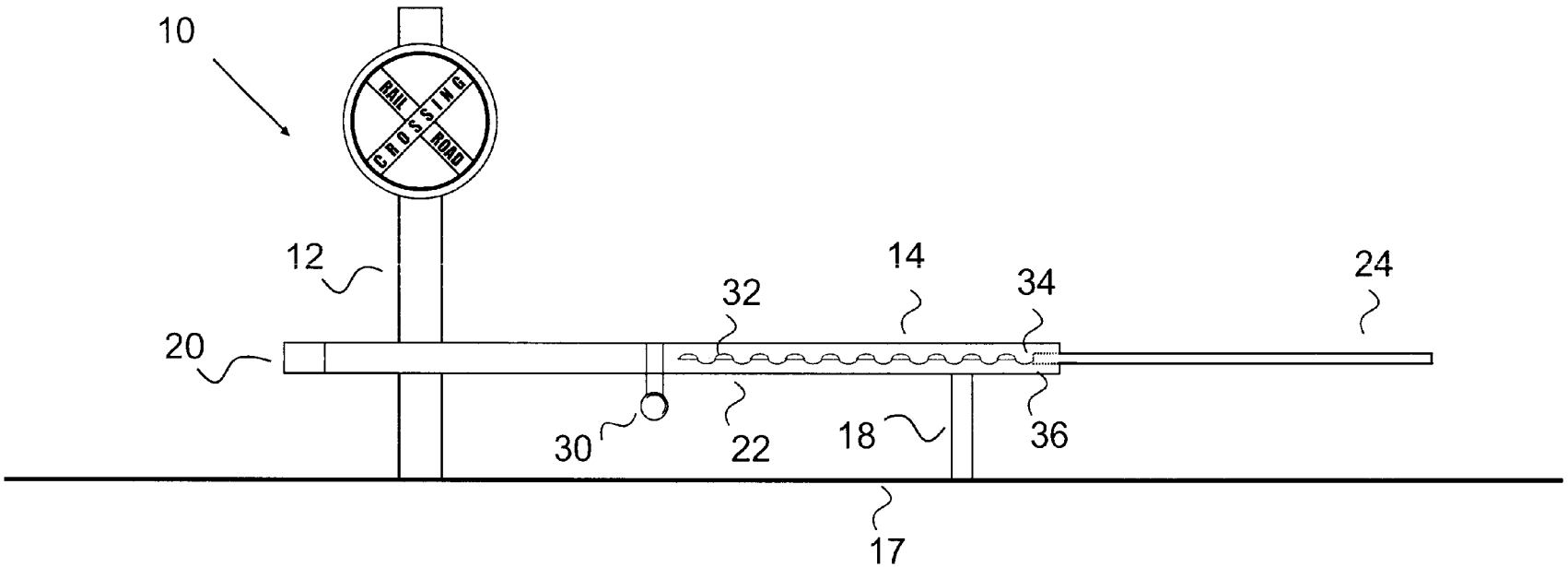
FIG. 3 is a front elevational view of the railroad grade crossing assembly of FIG. 1 in a second train approaching position whereupon the telescopic arm assembly extends outwardly such that the arm assembly completely closes the gate crossing prior to arrival of the train.

Referring now to FIGS. 1 through 3 of the drawings, a first embodiment of a railroad grade crossing assembly in accordance with the teachings of the present invention is illustrated. This railroad grade crossing assembly 10 of the present invention can be adapted to an existing stanchion and light assembly 12 which included a gate assembly (not shown) which only partially closed the railroad crossing.

Here, the railroad grade crossing assembly 10 of the present invention is formed of an improved gate assembly 14 which is connectable to the existing stanchion and light assembly 12. As is shown in FIGS. 1 through 3, the gate assembly 14 includes a two piece telescopic arm assembly 16 and a gravity actuated support leg 18. This arm assembly is movable between a generally upright position (see FIG. 1) and a generally horizontal position (see FIGS. 2 and 3). In the generally upright position of the arm assembly 14 of FIG. 1, the base of the arm assembly 19 is held in a generally horizontal orientation by a counterweight 20.

This telescopic arm assembly includes a first arm member 22 and a second arm member 24 extendable and retractable from the first arm member 22. In accordance with one of the general objects of the present invention, the operation of the gate assembly 16 complies with federal, state and local regulations regarding time requirements for closing a railroad crossing. As is shown in FIG. 2, upon a first pre-set interval prior to a train arriving at the railroad crossing, the gate assembly 14 falls from its generally upright position of FIG. 1 to a generally horizontal position of FIG. 2 and the support leg 18 falls by gravity into a generally vertical position impinging on the ground surface 17 to thereby support the arm member 14. Upon a second pre-set interval prior to a train arriving at the railroad crossing, the second arm member 24 of the gate assembly 14 extends outwardly from the first arm member 22 to completely close the railroad crossing (see FIG. 3). After the train has passed the railroad crossing, the second arm member 24 retracts with respect to the first arm member 22 so as to be in the position of FIG. 2. Thereafter, the gate assembly 14 is moved from its generally horizontal position of FIG. 2 to its generally upright position of FIG. 1.

FIG. 3 best illustrates the first embodiment actuating mechanism for extending and retracting the second arm 24 with respect to the first arm member 22 of the telescopic arm mechanism 14 for completely closing and opening the railroad crossing to vehicle access. This actuating mechanism includes a DC motor with right angle device 30 which turns a threaded rod 32 which is mated with a compatible nut 34 attached to an end 36 of the second arm member 24 so as to extend and retract the second arm member 24 depending upon the rotation of the DC motor 30.

A second embodiment of a railroad grade crossing assembly according to the present invention is illustrated in FIGS. 4–7.

Figure 4:
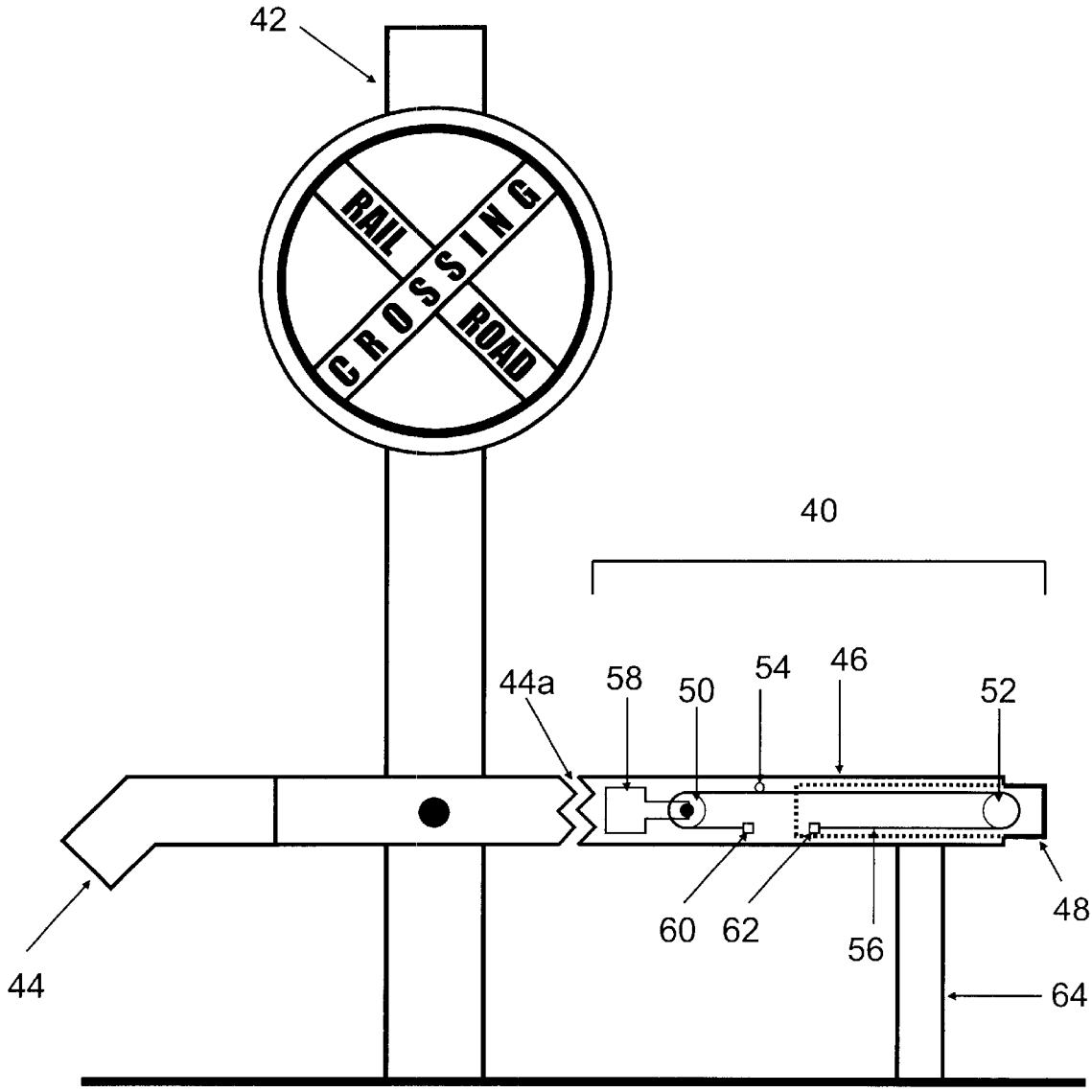
FIG. 4 is a plan view of a railroad grade crossing assembly in accordance with a second embodiment of the invention.

FIG. 4 is a plan view showing a railroad grade crossing assembly 40 according to the second embodiment, and showing how the railroad grade crossing assembly according to the second embodiment can be attached to a preexisting stanchion 42 and arm assembly 44. As can be seen from the figure, the crossing assembly includes an outer gate 46 and an inner (or "telescoping") gate 48. The assembly of the invention is attached to a preexisting stanchion 42 and arm 44 by cutting arm 44 as indicated at position 44*a* and then splicing outer gate 46 to the arm.

More specifically, the crossing assembly of the invention can be employed at existing railroad crossings by laying assembly 40 across the roadway where it is to be used such that the assembly in its extended state would completely close the roadway at the location of the existing stanchion. Once the assembly is laid out in this fashion, one can determine the appropriate positions at which to cut the existing arm 44 and/or outer gate 46 so that following splicing of the remaining arm portion and outer gate the resulting railroad crossing system will have the correct extended length for completely closing off the roadway. Employing the assembly of the invention in this manner, facilitates the supply of assemblies by allowing the manufacture of standard size assemblies (e.g. "2 lane" and "4 lane") which can then be trimmed to the precise length required.

In order to effect telescoping operation of inner gate 48, assembly 40 includes three pulleys 50, 52 and 54, a cable 56 which operates in conjunction with the pulleys, a motor 58 and two tension fasteners 60 and 62. In addition, the assembly includes a support leg 64 like leg 18 of FIGS. 1–3. In order to provide durability and the desired operating properties it is preferred that the cable be a vinyl coated steel cable of aircraft quality.

When extension of the inner gate is desired, the motor (e.g. a DC electric motor) produces a counter clockwise turning force on pulley 50 which is a deep V-type pulley. Upon application of the counter clockwise force pulley 50 exerts a longitudinal force on cable 56 (right to left in the figure). The force exerted on the cable is, in turn, transferred via pulled 52 onto tension fastener 62 (as a left to right force in the figure). Since pulley 50 is coupled to the outer gate which is secured to stanchion 42, and pulley 52 and tension coupling 62 are coupled to the inner gate which is free to extend out of the outer gate, the resulting force on tension coupling 62 moves the inner gate into an extended position.

Pulley 54 is an idling pulley which contacts cable 56 and is coupled to a switch (not shown) that triggers a reverse telescoping mechanism (not shown in FIG. 4) in the event the inner gate encounters an obstruction as it telescopes out of the outer gate. The pulley 54 is free to move in a vertical direction and is spring loaded with a downward bias such that its initial vertical position is determined according to the spring force and the vertical force which is exerted on the pulley due to the tension in cable 56. If inner gate 48 is obstructed from its extension while motor 58 is exerting a counter clockwise force on pulley 50, the tension in cable 56 increases, thereby moving pulley 54 upward and triggering the switch which activates the reversing mechanism. In this manner damage to the assembly and to objects in the path of the telescoping inner gate (e.g. an automobile) can be minimized.

Figure 5:
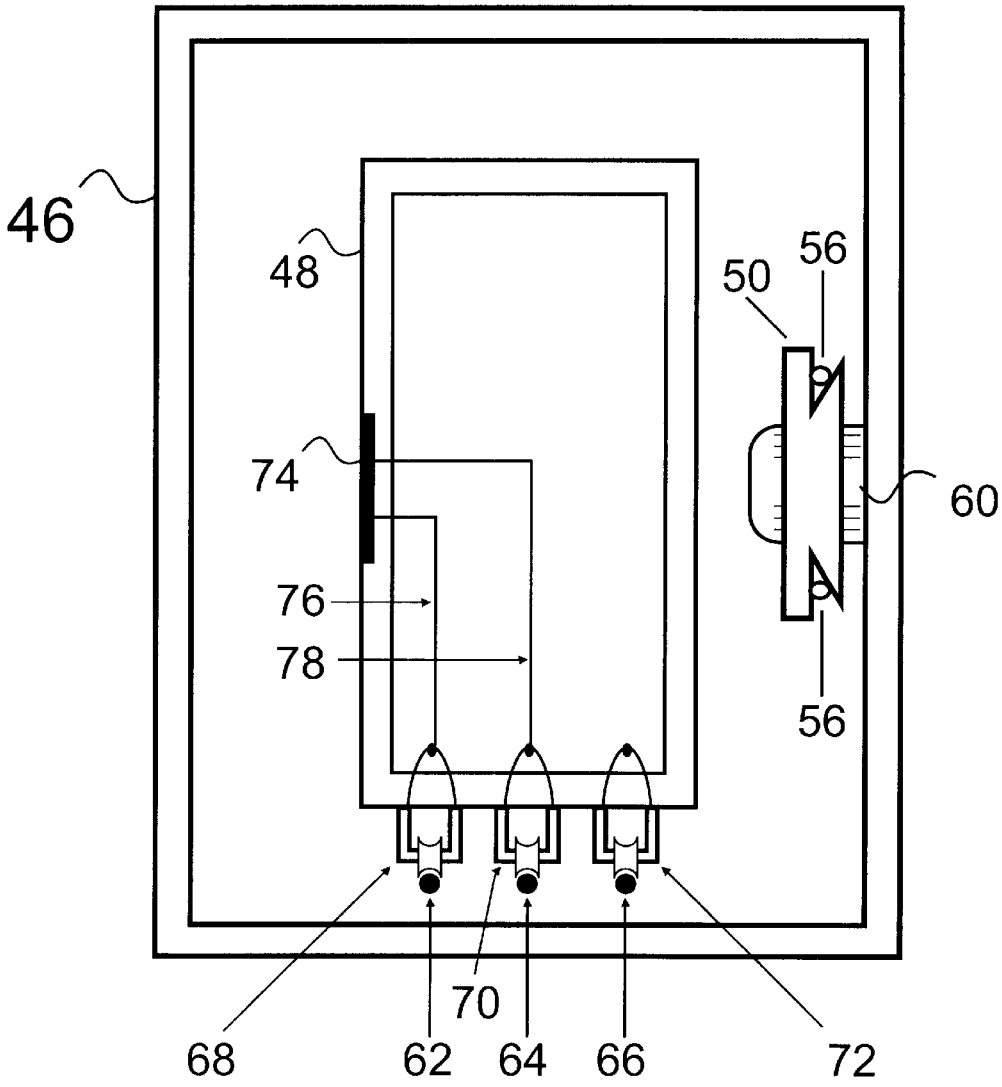
FIG. 5 is a cross-section view of the assembly shown in FIG. 4.

FIG. 5 is a cross-section view of the assembly shown in FIG. 4. For simplicity of presentation, the motor 58 of FIG. 4 is not shown in FIG. 6, but rather deep V pulley 50 is simply shown as being fixed in a rotatable manner to the outer gate 46 via an axle having a spline 60. As can be seen from FIG. 6, tension on cable 56 acts to wedge the cable in the V-shaped rim of pulley 50, thereby facilitating the transfer of force on the pulley into longitudinal force in the cable.

Along the inner surface of the outer gate are situated a multiple of electrically conducting rods 62, 64 and 66, preferably ⅛" diameter. Although three conducting rods are shown in the figure any number or rods may be used. In any event the rods serve a dual purpose, they aid in guiding the inner gate during telescoping and retracting operation and they provide electrical current and grounding along the length of the assembly. The rods are accessed by the inner gate via a multiple of conducting wheel arrangements 68–72, and in the illustrated embodiment the rods and wheel arrangements provide power to lights positioned on the inner gate. In the figure, a flush mounted inner gate light 74 is shown electrically connected to the rods 62 and 64 via couplings 76 and 78, respectively.

Figure 6:
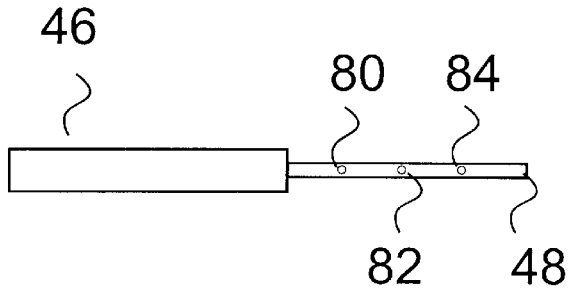
FIG. 6 is shows the gate assembly of the second embodiment in an extended position.

FIG. 6 shows a gate assembly of the invention in an extended position. The inner gate of the figure includes three flush mounted lights 80, 82 and 84, and in a preferred configuration lights 82 and 84 flash when the inner gate is extended, while light 80 remains on constantly when the inner gate is extended. Such configuration can be achieved by supplying a constant current signal through one of the rods, a flashing current signal through another one of the rods, and a ground signal through the remaining rod. Furthermore, such signals can be readily supplied to the rods via the couplings that typically exist at current railroad crossings. Thus, facilitating the provision of warning light indications with the assembly of the present invention.

Moreover, it should be noted that bulbs with bayonet type connectors may be used in/as the inner gate lights. Such bulbs are inserted into a socket by simply placing the connector end of the bulb into the socket and twisting less than a full turn.

Having described the embodiments of FIGS. 1–3 and FIGS. 4–7, it should be noted that in any of the embodiments extension of the inner gate may be triggered through circuitry provided in current railroad crossing systems, through a leveling switch which initiates extension when the gate arm becomes substantially horizontal in relation to the road, through a PLC (Programmable Logic Controller), or through some combination of the aforementioned techniques.

Further, in order to keep rain, snow, and ice, etc. from the gate assembly when the gate assembly is in its generally upright position (as shown for example in FIG. 1) the first arm member 22 or outer gate includes a waterproof covering member, such as a waterproof boot (e.g. boot 38 of FIG. 1) at an end thereof.

Figure 7:
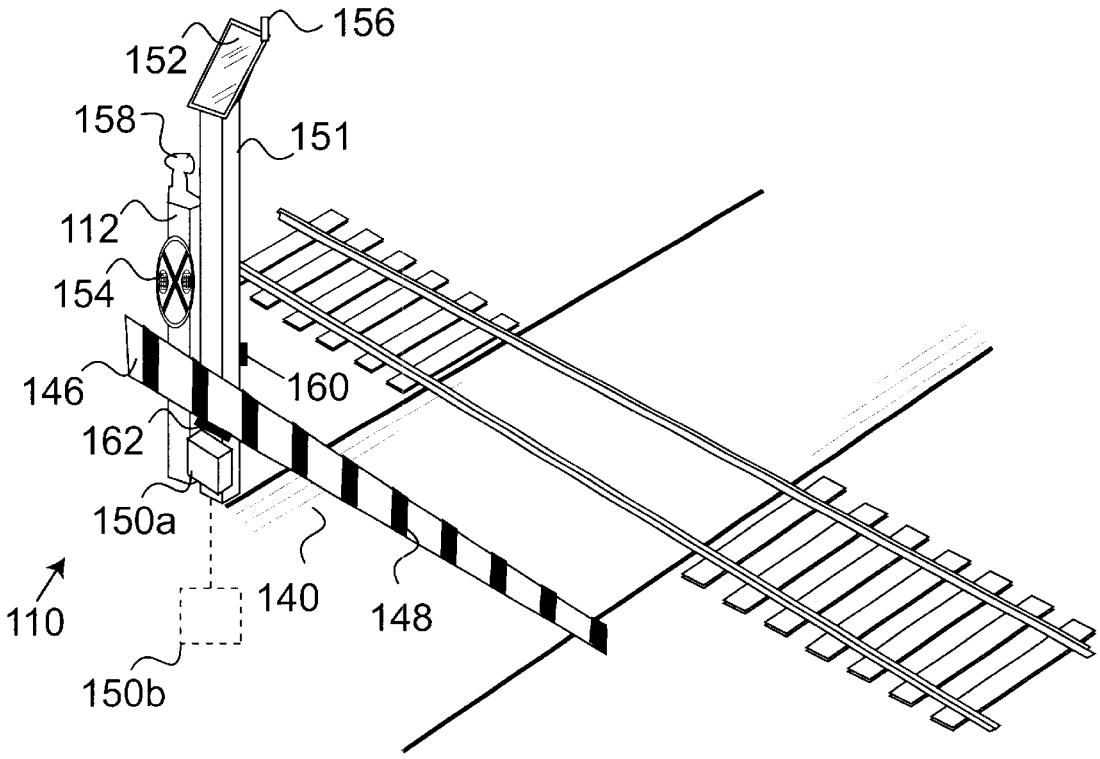
FIG. 7 is shows the gate assembly of the third embodiment of the present invention.

Referring now to FIG. 7 of the drawings, a third embodiment of a railroad grade crossing assembly in accordance with the teachings of the present invention is illustrated. This railroad gate crossing assembly 110 of the present invention is self contained and can be adapted to an existing stanchion and light assembly 112 which may or may not included a gate assembly (not shown) which only partially closed the railroad crossing. The assembly provides its own power supply.

Here, the railroad grade crossing assembly 110 of the present invention is formed of an improved gate assembly 140 which is connectable to the existing stanchion 112. As can be seen from the figure, the crossing assembly includes an outer gate 146 and an inner (or "telescoping") gate 148. The assembly of the invention is attached to a preexisting stanchion 112.

More specifically, the crossing assembly of the invention can be employed at existing railroad crossings by laying assembly 140 across the roadway where it is to be used such that the assembly in its extended state would completely close the roadway at the location of the existing stanchion 112.

This telescopic arm assembly includes a first arm member 146 and a second arm member 148 which is extendable and retractable from the first arm member 146. In order to effect telescoping operation of inner gate 148, the internal workings of assembly 140 operates as assembly 40 described above.

A second post 151 is added on the same side of the roadway as the existing stanchion 112 to receive the inner gate 148. Mounted on the second post 151 is a battery enclosure **150*a* containing a battery. The battery may also be mounted under ground as in battery enclosure 150*b*. Attached to the top of second post 151 is a solar battery charger 152 for charging the battery contained in battery enclosures 150*a* and 150*b*. Lights 154 may be added to the existing stanchion 112 and powered by the battery. A low voltage indicator is mounted on the second post 151 for indicating to passing trains that the voltage of the battery is low. A listening device 158 is mounted on top of the existing stanchion and an electronic eye sensor 160 is mounted near the vertical center of the existing stanchion 112**.

When a train is approaching and extension of the inner gate 148 is desired, the oncoming train signals the listening device 158 by sounding the train's whistle. When this occurs, the lights 154 begin to flash, and a motor (not shown) moves the inner gate 148 into an extended position where it contacts the second post 151 and rests on ledge 162 as shown in FIG. 7. The Outer Gate 146 does not move as in the previous embodiments, but remains, at all times, parallel to both the ground and the train tracks as shown in FIG. 8.

This action completely closes the railroad crossing. After the electric eye 160 has determined that the train has passed the railroad crossing, the inner gate 148 retracts with respect to the outer gate 146. If the voltage of the battery ever becomes low, warning light 156 is illuminated when the inner gate 148 is extended, to notify the passing train.

Accordingly, in accordance with one of the general objects of the present invention, an improved railroad grade crossing assembly for completely closing a railroad gate crossing prior to arrival of a train has been provided. In addition, this railroad grade crossing assembly of the present invention is adaptable to the existing stanchion, arm and/or light assemblies that are presently in place. Moreover, since the arm assembly of the present invention is readily connectable to the existing stanchion, arm and/or light assembly, this improved railroad gate assembly is relatively inexpensive.

Although the invention has particularly shown and described with reference to certain preferred embodiments, it will be readily appreciated by those of ordinary skill in the art that various changes and modifications may be made therein without departing from the spirit and scope of the invention. It is intended that the appended claims be interpreted as including the foregoing as well as various other such changes and modifications.

What is claimed is:

1. A railroad grade crossing assembly for blocking vehicle access across a railroad crossing, comprising:

gate means connectable to a stanchion and light assembly and movable between a generally upright position to permit vehicle access across a railroad crossing and a generally horizontal position for blocking vehicle access across a railroad crossing; and telescopic arm means incorporated into said gate means for automatically completely closing the railroad crossing when said gate means is in said generally horizontal position;

whereby said telescopic arm means is movably incorporated within said gate means and is operable to extend from said gate means each time said crossing assembly is to block vehicle access across said crossing and retracts each time said crossing assembly is to permit vehicle access across said crossing.

2. The railroad grade crossing assembly of claim 1, wherein said gate means further includes a gravity actuated support leg.

3. The railroad grade crossing assembly of claim 1, wherein upon a first pre-set interval prior to a train arriving at the railroad crossing, said gate means falls from its said generally upright position to a generally horizontal position and said support leg falls by gravity into a generally vertical position supporting said telescopic arm means.

4. The railroad grade crossing assembly of claim 3, wherein upon a second pre-set interval prior to a train arriving at the railroad crossing, a second arm means of said gate means extends outwardly from said gate means to completely close the railroad crossing.

5. The railroad grade crossing assembly of claim 1, further comprising actuating means for extending and retracting said telescopic arm means for completely closing and opening the railroad crossing to vehicle access.

6. The railroad grade crossing assembly of claim 5, wherein said actuating means includes motor means for turning a threaded rod which is mated with fastening means attached to an end of said telescopic arm means so as to extend and retract said telescopic arm means depending upon the rotation of said motor means.

7. The railroad grade crossing assembly of claim 5, wherein said actuating means includes motor means for applying a turning force to a pulley which exerts a force in a cable in order to extend said telescopic arm means.

8. The railroad grade crossing assembly of claim 1, further comprising means for reversing extension of said telescopic arm means when said telescopic arm means encounters an obstruction during extension.

9. The railroad grade crossing assembly of claim 1, wherein said telescopic arm means includes lights visible to a car when said telescopic arm means is extended.

10. The railroad grade crossing assembly of claim 1, wherein electrical current is supplied to said telescopic arm means through a plurality of conducting rods positioned in said gate means and a plurality of conducting wheel arrangements which contact said rods.

11. The railroad grade crossing assembly of claim 1, wherein said gate means includes waterproof covering means at an end thereof to keep rain, snow, and ice away from said gate means when said gate means is in its generally upright position.

12. A railroad grade crossing assembly for blocking vehicle access across a railroad crossing, comprising:

gate means movable between a generally upright position to permit vehicle access across a railroad crossing and a generally horizontal position for blocking vehicle access across a railroad crossing, said gate means having telescopic arm means for completely closing the railroad crossing, and a gravity actuated support leg, said telescopic arm means being extendable and retractable from said gate means wherein upon a first pre-set interval prior to a train arriving at a railroad crossing, said gate means falls from its said generally upright position to a generally horizontal position and said support leg falls by gravity into a generally vertical position supporting said telescopic arm means, and wherein upon a second pre-set interval prior to a train arriving at the railroad crossing, said telescopic arm means extends outwardly from said gate means to completely close the railroad crossing.

13. The railroad grade crossing assembly of claim 12, wherein said gate means is connectable to a railroad crossing stanchion and light assembly.

14. The railroad grade crossing assembly of claim 12, further comprising actuating means for extending and retracting said telescopic arm means for completely closing and opening the railroad crossing to vehicle access.

15. The railroad grade crossing assembly of claim 14, wherein said actuating means includes motor means for turning a threaded rod which is mated with fastening means attached to an end of said telescopic arm means so as to extend and retract said telescopic arm means depending upon the rotation of said motor means.

16. The railroad grade crossing assembly of claim 14, wherein said actuating means includes motor means for applying a turning force to a pulley which exerts force in a cable in order to extend said telescopic arm means.

17. The railroad grade crossing assembly of claim 12, further comprising means for reversing extension of said telescopic arm means when said telescopic arm means encounters an obstruction during extension.

18. The railroad grade crossing assembly of claim 12, wherein said telescopic arm means includes lights visible to a car when said telescopic arm means is extended.

19. The railroad grade crossing assembly of claim 12, wherein electrical current is supplied to said telescopic arm means through a plurality of conducting rods positioned in said gate means and a plurality of conducting wheel arrangements which contact said rods.

20. The railroad grade crossing assembly of claim 12, wherein said gate means includes waterproof covering means at an end thereof to keep rain, snow, and ice away from said gate means when said gate means is in its generally upright position.

21. A railroad grade crossing assembly for blocking vehicle access across a railroad crossing, comprising:

gate means connectable to a stanchion and light assembly;

automatic telescopic arm means incorporated into said gate means for completely closing the railroad crossing; and a gravity actuated support leg for supporting said telescopic arm means;

whereby said telescopic arm means is movably incorporated within said gate means and is operable to extend from said gate means each time said crossing assembly is to block vehicle access across said crossing and retracts each time said crossing assembly is to permit vehicle access across said crossing.

22. The railroad grade crossing assembly of claim 21, wherein said gate means is movable between a generally upright position to permit vehicle access across a railroad crossing and a generally horizontal position for blocking vehicle access across the railroad crossing.

23. The railroad grade crossing assembly of claim 21, wherein upon a first pre-set interval prior to a train arriving at the railroad crossing, said gate means falls from its said generally upright position to a generally horizontal position and said support leg falls by gravity into a generally vertical position supporting said telescopic arm means.

24. The railroad grade crossing assembly of claim 23, wherein upon a second pre-set interval prior to a train arriving at the railroad crossing, said telescopic arm means extends outwardly from said gate means to completely close the railroad crossing.

25. The railroad grade crossing assembly of claim 21, further comprising actuating means for extending and retracting said telescopic arm means for completely closing and opening the railroad crossing to vehicle access.

26. The railroad grade crossing assembly of claim 25, wherein said actuating means includes motor means for applying a turning force to a pulley which exerts force in a cable in order to extend said telescopic arm means.

27. The railroad grade crossing assembly of claim 21, further comprising means for reversing extension of said telescopic arm means when said telescopic arm means encounters an obstruction during extension.

28. The railroad grade crossing assembly of claim 21, wherein said telescopic arm means includes lights visible to a car when said telescopic arm means is extended.

29. The railroad grade crossing assembly of claim 21, wherein electrical current is supplied to said telescopic arm means through a plurality of conducting rods positioned in said gate means and a plurality of conducting wheel arrangements which contact said rods.

30. A railroad grade crossing assembly for blocking vehicle access across a railroad crossing, comprising:

gate means connected to a stanchion and light assembly and movable between a generally retracted position to permit vehicle access across a railroad crossing and a generally extended position for blocking vehicle access across the railroad crossing using an automatic telescopic arm means incorporated into said gate means for completely closing the railroad crossing when said gate means is in said generally horizontal position;

whereby said telescopic arm means is movably incorporated within said gate means and is operable to extend from said gate means each time said crossing assembly is to block vehicle access across said railroad crossing and retracts each time said crossing assembly is to permit vehicle access across said railroad crossing.

31. The railroad grade crossing assembly of claim 30, wherein said gate means further includes a second stanchion.

32. The railroad grade crossing assembly of claim 30, further comprising actuating means for extending and retracting said telescopic arm means for completely closing and opening the railroad crossing to vehicle access.

33. The railroad grade crossing assembly of claim 32, wherein said actuating means includes motor means for turning a threaded rod which is mated with fastening means attached to an end of said telescopic arm means so as to extend and retract said telescopic arm means depending upon the rotation of said motor means.

34. The railroad grade crossing assembly of claim 32, wherein said actuating means includes motor means for applying a turning force to a pulley which exerts force in a cable in order to extend said telescopic arm means.

35. The railroad grade crossing assembly of claim 30, further comprising means for reversing extension of said telescopic arm means when said telescopic arm means encounters an obstruction during extension.

36. A railroad grade crossing assembly for blocking vehicle access across a railroad crossing, comprising:

gate means movable between a generally horizontal retracted position to permit vehicle access across the railroad crossing and a generally extended horizontal position for blocking vehicle access across the railroad crossing, said gate means having telescopic arm means for completely closing the railroad crossing, and a first and second stanchions, said telescopic arm means being extendable and retractable from said gate means wherein upon a pre-set interval prior to a train arriving at the railroad crossing, said gate means extends from its said generally retracted position to a generally extended position extending from said first stanchion to said second stanchion, to completely close the railroad crossing.

37. The railroad grade crossing assembly of claim 36, wherein said gate means is connectable to an existing railroad crossing stanchion and light assembly.

38. The railroad grade crossing assembly of claim 36, further comprising actuating means for extending and retracting said telescopic arm means for completely closing and opening the railroad crossing to vehicle access.

39. The railroad grade crossing assembly of claim 38, wherein said actuating means includes motor means for turning a threaded rod which is mated with fastening means attached to an end of said telescopic arm means so as to extend and retract said telescopic arm means depending upon the rotation of said motor means.

40. The railroad grade crossing assembly of claim 38, wherein said actuating means includes motor means for applying a turning force to a pulley which exerts force in a cable in order to extend said telescopic arm means.

41. The railroad grade crossing assembly of claim 36, further comprising means for reversing extension of said telescopic arm means when said telescopic arm means encounters an obstruction during extension.

42. The railroad grade crossing assembly of claim 36, and further comprising a battery to power said gate means and a solar panel to recharge said battery.

43. The railroad grade crossing assembly of claim 42, wherein said battery is placed underground.

44. The railroad grade crossing assembly of claim 42, and further comprising a low battery indicator to indicate that said battery has a low voltage.

45. The railroad grade crossing assembly of claim 36, and further comprising a listening device to detect the sound of an oncoming train and activate the gate means.

46. The railroad grade crossing assembly of claim 36, and further comprising a sensor to sense when a train has passed and thereby cause said gate means to retract.

47. A railroad grade crossing assembly for blocking vehicle access across a railroad crossing, comprising:

gate means connectable to a stanchion and light assembly;

automatic telescopic arm means incorporated into said gate means for completely closing the railroad crossing; and a second stanchion for supporting said telescopic arm means;

whereby said telescopic arm means is movably incorporated within said gate means and is operable to extend from said gate means each time said crossing assembly is to block vehicle access across said railroad crossing and retracts each time said crossing assembly is to permit vehicle access across said railroad crossing.

* * * * *